US007100977B2

(12) United States Patent
Burwell et al.

(10) Patent No.: US 7,100,977 B2
(45) Date of Patent: Sep. 5, 2006

(54) DETACHABLE SUPPORT ARM

(75) Inventors: Damon Gregory Burwell, Upper Hutt (NZ); Paul Michael Wilkinson, Wellington (NZ)

(73) Assignee: Formway Furniture Limited, Wellington (NZ)

( * ) Notice: Subject to any disclaimer, the term of this patent is extended or adjusted under 35 U.S.C. 154(b) by 0 days.

(21) Appl. No.: 10/449,853

(22) Filed: May 30, 2003

(65) Prior Publication Data

US 2003/0227208 A1 Dec. 11, 2003

(30) Foreign Application Priority Data

May 31, 2002 (NZ) ..... 519307

(51) Int. Cl.
*A47B 39/00* (2006.01)

(52) U.S. Cl. ..... 297/170; 297/173

(58) Field of Classification Search ..... 297/162, 297/160, 170, 173, 174 R, 135, 463.1, 440.1; 248/218.4, 229.15, 229.25, 230.6, 231.71
See application file for complete search history.

(56) References Cited

U.S. PATENT DOCUMENTS 1,217,783 A * 2/1917 Langslow ..... 297/170
2,857,958 A 10/1958 Wright
2,925,123 A 2/1960 Morgan
3,082,036 A 3/1963 Albinson
3,194,600 A 7/1965 Junkunc
3,197,253 A 7/1965 Brown
3,622,199 A 11/1971 Ho
3,628,832 A 12/1971 Jennings
3,632,163 A 1/1972 Burnham
3,680,911 A 8/1972 Dupuis
3,713,262 A * 1/1973 Jatcko ..... 52/98
3,751,108 A 8/1973 Bakanowsky
3,784,249 A 1/1974 Hendrickson et al.
3,814,474 A 6/1974 Baker et al.
3,847,432 A 11/1974 Jennings
4,120,532 A 10/1978 Clanan
4,138,953 A 2/1979 Tashman
4,159,846 A 7/1979 Tolleson
4,288,123 A 9/1981 Cone
4,300,798 A 11/1981 Musgrove et al.
4,848,833 A 7/1989 Grall
4,861,102 A 8/1989 Fuller
4,913,393 A * 4/1990 Wood ..... 248/230.2
5,048,428 A 9/1991 LaRue
5,454,581 A 10/1995 Ringer
5,462,247 A * 10/1995 Aldrich ..... 248/118

(Continued)

FOREIGN PATENT DOCUMENTS

WO WO 94/27472 12/1994

*Primary Examiner*—Milton Nelson, Jr.
(74) *Attorney, Agent, or Firm*—Workman Nydegger

(57) ABSTRACT

A support arm for supporting an item from a tapered member such as a tapered chair arm includes an arm portion having a proximal end and a distal end. At or toward the distal end is an arrangement for mounting an item. At or toward the proximal end is an attachment portion defining an internal taper. The support arm is engageable on the tapered member in a taper lock between the tapered member and the attachment portion and disengageable manually and without the use of tools, to mount the support arm to the tapered member. The item is preferably a tablet. One or more release shuttles may be provided within the attachment portion to enhance the disengagement of the support arm from the tapered member.

65 Claims, 11 Drawing Sheets

U.S. PATENT DOCUMENTS 5,564,779 A 10/1996 Tolbert et al.
5,816,649 A 10/1998 Shields
5,865,124 A * 2/1999 Wroe ..... 108/26
6,056,361 A 5/2000 Cvek
6,062,640 A * 5/2000 Stahl ..... 297/135
6,073,997 A 6/2000 Koh
6,241,033 B1 * 6/2001 Hoffman ..... 175/320
6,481,679 B1 * 11/2002 Bennett et al. ..... 248/224.51
6,685,264 B1 * 2/2004 Mullen et al. ..... 297/173

* cited by examiner

DETACHABLE SUPPORT ARM

CROSS-REFERENCE TO RELATED APPLICATIONS

The present application claims priority to New Zealand Application No. 519307, filed May 31, 2002, which is incorporated herein by specific reference.

BACKGROUND OF THE INVENTION

1. The Field of the Invention

The present invention relates to a detachable support arm having a toolless attachment portion. In particular, although not exclusively, the invention relates to a detachable support arm having a toolless attachment portion which is attachable to an arm assembly of a chair to support a tablet work surface. However, the support arm may be used to support a number of different items. Further, the support arm also has application beyond chairs.

2. The Relevant Technology

In order to provide a work surface which does not take up excessive space, it is known to attach the work surface to a chair, such as a chair in a university lecture theatre for example, rather than providing a separate table or desk. Such work surfaces are often permanently affixed to the chairs. It is known to provide a detachable tablet or work surface for attachment to a chair, although known detachable tablets generally require fastening to part of the chair through bolts or screws. Attachment or detachment may require the use of a tool and can be time consuming.

In the modern office environment it may be useful for a chair occupant to be able to readily attach and detach a work surface to his office chair, in a short amount of time and with minimum fuss. Most office workers do not have readily-available tools in order to attach such a work surface to their chair.

It is therefore an object of the present invention to provide a support arm which is more readily attachable and detachable and/or which at least provides the public with a useful choice.

In accordance with a first aspect of the present invention, there is provided a support arm for supporting an item from a tapered member such as a tapered chair arm, the support arm including: an arm portion having a proximal end and a distal end; at or toward the distal end, an arrangement for mounting an item; and at or toward the proximal end, an attachment portion defining an internal taper, whereby the support arm is engageable on the tapered member in a taper lock between the tapered member and the attachment portion and disengageable manually and without the use of tools, to mount the support arm to the tapered member.

The internal taper of the attachment portion preferably substantially corresponds to the taper of the tapered member.

Preferably, the tapered member converges towards its upper end, and the internal taper in the attachment portion of the support arm converges towards its upper end, so that moving the attachment portion downwardly relative to the tapered member engages the respective tapers together. It will be appreciated that such a movement could be achieved under the influence of, or assisted by, gravity.

Suitably, the tapered member has an eccentric or polygonal shape in cross section, with the interior of the attachment portion having a cross-sectional shape which substantially corresponds to at least part of the shape of the tapered member so that rotation between the attachment portion and tapered member is inhibited when the tapers are engaged. The tapered member is preferably substantially square or rectangular in cross section.

Preferably, the attachment portion has an open part so that the interior of the attachment portion may be engaged with the tapered member by moving it into contact from the side, front or rear of the tapered member, and then sliding the attachment portion along the tapered member so that the tapers engage. More preferably, the attachment portion has an open side so that the interior of the attachment portion may be engaged with the tapered member by moving it into contact from the side of the tapered member, and then sliding the attachment portion along the tapered member so that the tapers engage. This is particularly suitable when the support arm is to be mounted to a chair arm, as it enables the attachment portion to be engaged with the chair arm by moving it in a sideways manner from the side of the chair opposite to the seating surface. It will be appreciated that the attachment portion may be arranged to be moved towards the chair arm from the left side or right side of the chair, depending on particular requirements.

The attachment portion is preferably substantially "C" shaped in internal cross section. The attachment portion preferably includes protrusions extending from the edges of the substantially "C" shape, partially across the open part, the protrusions sized to make it more difficult for the attachment portion to be removed in a sideways manner from the tapered member when the tapered parts are engaged, but to allow the attachment portion to be removed through the spaces between the protrusions when the tapered parts are not engaged.

In a preferred embodiment, the interior of the attachment portion includes one or more release shuttles, each of which is slidable relative to the attachment portion and arranged to engage the outer surface of the tapered member when the tapered member and the attachment portion are engaged. Advantageously, the attachment portion is substantially "C" shaped in internal cross section, and the or each spring-loaded release shuttle is substantially "C" shaped. The ends of the substantial "C" shape of the or each shuttle preferably extends so as to make it more difficult for the attachment portion to be removed in a sideways manner from the tapered member when the tapered parts are engaged, but to allow the attachment portion to be removed through the spaces between the ends of the shuttle(s) when the tapered portions are not engaged. When the attachment portion includes protrusions extending from the edges of the substantially "C" shape, the or each release shuttle is preferably substantially aligned with respective protrusions extending from the substantially "C" shaped attachment portion.

Suitably, the included angle between the front and rear inner surfaces of the or each release shuttle substantially corresponds to the included angle between the front and rear outer surfaces of the tapered member. The included angle between the front and rear inner surfaces of the or each release shuttle is preferably about 2 to 3 degrees.

Preferably, the included angle between the front and rear outer surfaces of the or each release shuttle, and the included angle between the front and rear inner surfaces of the attachment portion in the region of the or each release shuttle, is greater than the included angle between the front and rear inner surfaces of the or each release shuttle. The included angle between the front and rear outer surfaces of the or each release shuttle, and the included angle between the front and rear inner surfaces of the attachment portion in the region of the or each release shuttle, is preferably about 14 degrees.

Preferably, the included angle between the side inner surfaces of the or each release shuttle substantially corresponds to the included angle between the side outer surfaces of the tapered member. The included angle between the side inner surfaces of the or each release shuttle is preferably about 2 to 3 degrees.

Advantageously, the included angle between the side outer surfaces of the or each release shuttle, and the included angle between the side inner surfaces of the attachment portion in the region of the or each release shuttle, is greater than the included angle between the side inner surfaces of the or each release shuttle. The included angle between the side outer surfaces of the or each release shuttle, and the included angle between the side inner surfaces of the attachment portion in the region of the or each release shuttle, is preferably about 14 degrees.

In a most preferred embodiment, all inner and outer surfaces of the or each release shuttle, and of the attachment portion in the region of the or each release shuttle, are tapered. Preferably, the included angles between all opposing outer surfaces of the or each release shuttle, and between all opposing inner surfaces of the attachment portion in the region of the or each release shuttle, are greater than the included angles between all opposing inner surfaces of the or each release shuttle. The included angles between all opposing internal surfaces of the or each release shuttle are preferably about 2 to 3 degrees. The included angles between all opposing outer surfaces of the or each release shuttle, and between all opposing inner surfaces of the attachment portion in the region of the or each release shuttle, are preferably about 14 degrees.

In a preferred embodiment, at least a substantial part of the remainder of the interior of the attachment portion, other than the region(s) corresponding to the release shuttle(s), has an angle substantially corresponding to that of the tapered member.

Preferably, the or each release shuttle is biased towards the tapered end of the attachment portion. The or each release shuttle is preferably biased by one or more compression springs. Alternatively, the or each release shuttle may be biased by one or more leaf springs. Advantageously, the or each biased release shuttle is arranged such that as the attachment portion of the support arm is moved in the direction of its taper to detach it from the tapered member, the or each release shuttle initially moves with the tapered member, relative to the attachment portion, in a direction away from the taper and then snaps out of engagement with the tapered member to release the attachment portion from the tapered member.

Preferably, the or each release shuttle has a respective stop provided in the interior of the attachment portion to limit the movement of the or each release shuttle in a direction away from the taper.

The or each release shuttle is suitably made of a plastics material, and may be made from a self-lubricating plastic such as nylon for example.

It is preferred that two spaced release shuttles are provided in the attachment portion.

The arrangement for mounting an item preferably comprises a joint to which the item is attachable or attached. The item may be permanently mounted to the joint. Alternatively, the item may be removable from the joint and interchangeable with a further item. A "quick release" mechanism may be provided for that purpose.

The position of the item may be fixed relative to the arm assembly when the item is attached to the joint.

Alternatively, the joint may be configured to allow pivoting and rotating movement of the item relative to the arm portion. A pivoting and rotating joint is particularly useful when the support arm is to be attached to the arm of an office chair, as it enables the user to easily egress the chair, which is important for safety purposes. The pivoting and rotating joint is preferably indexed for rotation. In a preferred embodiment, the joint is indexed for rotation such that an item attached to the joint may be rotated up to about 20 degrees towards the user and up to about 30 degrees away from the user in a substantially horizontal plane.

The joint allows movement of the item between a use position in which it extends in a substantially perpendicular manner from the arm portion (for example over a seating surface of a chair when the support arm is mounted to a chair arm) and a storage portion in which it hangs beside the arm portion. The joint is preferably configured such that with the support arm attached to an arm of a chair and an item attached to the joint, a chair occupant can pivot the item in a substantially vertical plane towards the side of the chair so that it falls under the influence of gravity to the outside of the arm portion, or can rotate the item towards the front of the chair a sufficient distance that it will then pivot under the influence of gravity to the outside of the arm portion.

The arrangement to attach an item, or the item itself, may be configured to allow sliding of the item in at least one dimension relative to the arm portion. Preferably, the item is slidable in two dimensions relative to the arm portion.

The arm portion is preferably curved upwardly from the attachment portion such that the item is located above and forward of the attachment portion when the support arm is attached to a tapered member.

The arm portion may include a projection at or towards the distal end thereof, thereby forming a dogleg configuration, with the arrangement to attach an item provided at or adjacent a distal end of the projection.

The item is preferably one or more selected from the group of: a work surface or tablet, a work box for containing writing implements, a keyboard, a mouse pad, a notebook computer, and a cup holder. The item is most preferably a work surface mounted at or adjacent the distal end of the arm portion. The work surface is most preferably in the form of a tablet.

The tablet advantageously includes a cup holder to hold a cup, glass, tumbler, or the like.

The cup holder may be arranged to move between a position located in a recess in the tablet and a position located adjacent the tablet. The cup holder may be pivotally connected to the tablet. Alternatively, the cup holder may be slidably mounted in the tablet. The cup holder may include a four bar linkage to provide a cup supporting base when the cup holder is positioned adjacent the tablet, and which folds up upon returning the cup holder to the recess.

The cup holder preferably includes an elastomeric section to stabilize an item therein.

In accordance with a second aspect of the present invention, there is provided a support arm for supporting a work surface from a tapered chair arm, the support arm including: an arm portion having a proximal end and a distal end; a work surface mounted at or toward the distal end; and at or toward the proximal end, an attachment portion defining an internal taper, whereby the support arm is engageable on the tapered member in a taper lock between the tapered member and the attachment portion and disengageable manually and without the use of tools, to mount the support arm to the tapered member.

The tapered member may converge towards its upper end, and the internal taper in the attachment portion of the support arm may converge towards its upper end, so that moving the attachment portion downwardly relative to the tapered member engages the respective tapers together.

The work surface may be moveable between a position in which it extends in a substantially perpendicular manner from the arm portion and a storage portion in which it hangs beside the arm portion.

The work surface is preferably in the form of a tablet.

Preferably, the tablet includes a cup holder to hold a cup, glass, tumbler, or the like, and the cup holder is arranged to move between a position located in a recess in the tablet and a position located adjacent the tablet.

In accordance with a third aspect of the present invention, there is provided a chair comprising a base supporting a seat, a back, and a pair of tapered arm members, with a support arm as outlined in respect of either the first or second aspect above attached to one of the arm members, the support arm being disengageable from the arm member by moving it upwardly and outwardly relative to the arm member.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

Preferred embodiments of the present invention will now be described by way of example only and with reference to the accompanying drawings in which.

DETAILED DESCRIPTION OF THE PREFERRED EMBODIMENTS

Figure 1:
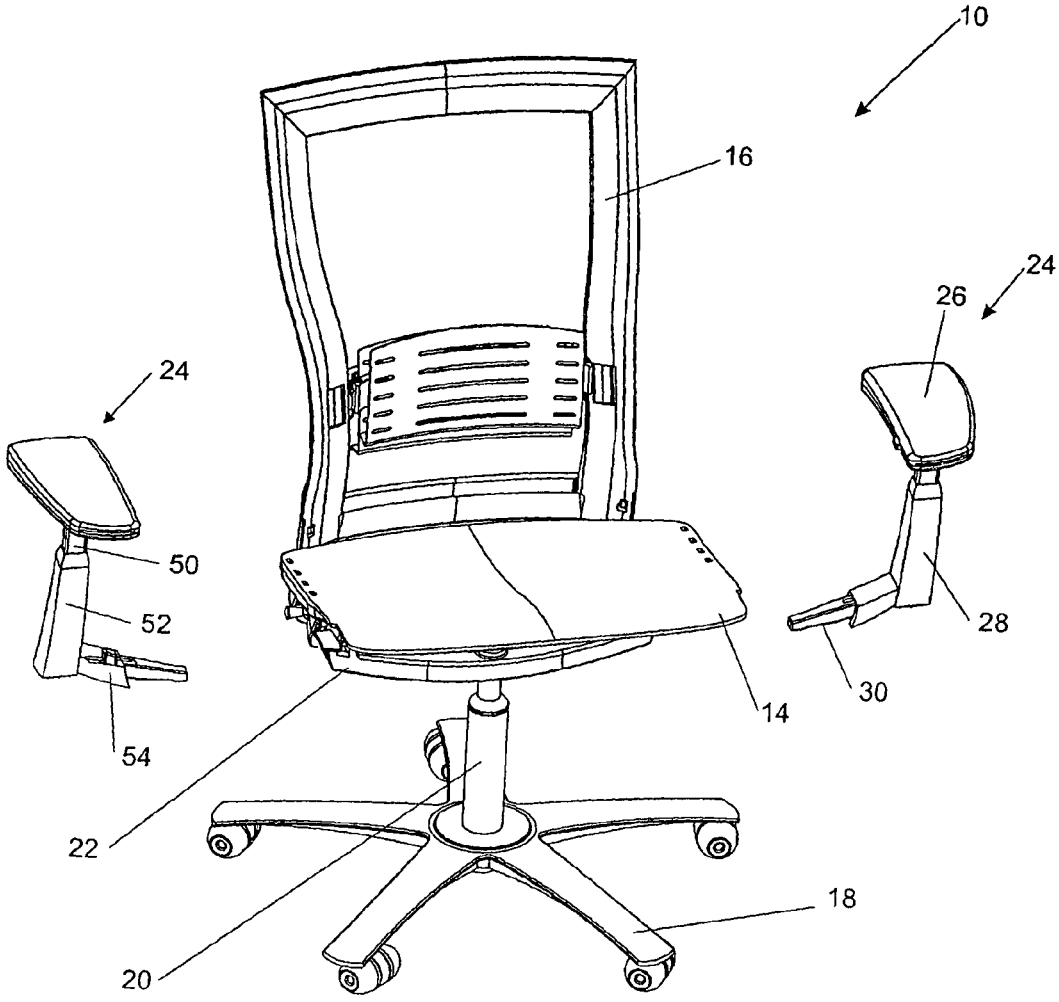
FIG. 1 is an exploded perspective view illustrating a chair with two detachable arm assemblies.

FIG. 1 illustrates an office chair with which the present invention may be used, the chair including a main assembly 10 having a seat portion 14 and a back portion 16. The seat portion 14 and the back portion 16 are supported above the ground by a support frame including a wheeled base 18 and a central support column 20. The support frame may also optionally include a mechanism enabling the back portion 16 to recline with a synchronous tilting action of the seat portion 14 as the back portion 16 reclines. The central support column 20 may house a pneumatic spring (not shown) for height adjustment of the seat portion 14 in conventional fashion. The pneumatic spring is connected to the main transom 22 of the chair, which extends transversely across the chair and is connected to the pneumatic spring by way of central spring connection ring.

FIG. 1 also illustrates two arm assemblies 24, which in the preferred embodiment are detachable. The arm assemblies 24 shown in FIG. 1 include an upper armrest 26 which is preferably padded for user comfort. Each arm assembly also includes an upright support structure 28. The armrest 26 is mounted to the upper end of the upright support structure 28. The lower end of the upright support structure has an elongate attachment portion 30 extending inwardly therefrom in a downwardly inclined angle. The elongate attachment portion 30 engages within one end of the main transom.

The support structure 28 of the arm assembly includes an upper stem 50 telescopically received in a hollow lower stem 52. The upper stem 50 and the lower stem 52 are adjustable relative to one another to effect height adjustment. Extending at a downwardly inclined angle from a lower part of the lower stem 52 is leg portion 54. The elongate attachment portion 30 may be connected to the lower end of the leg portion 54.

The upper stem 50 supports a fixed portion (not shown in FIG. 1) in normally fixed disposition thereto (given that the fixed portion is height adjustable). The armrest may be movably attached to the fixed portion.

Figure 2:
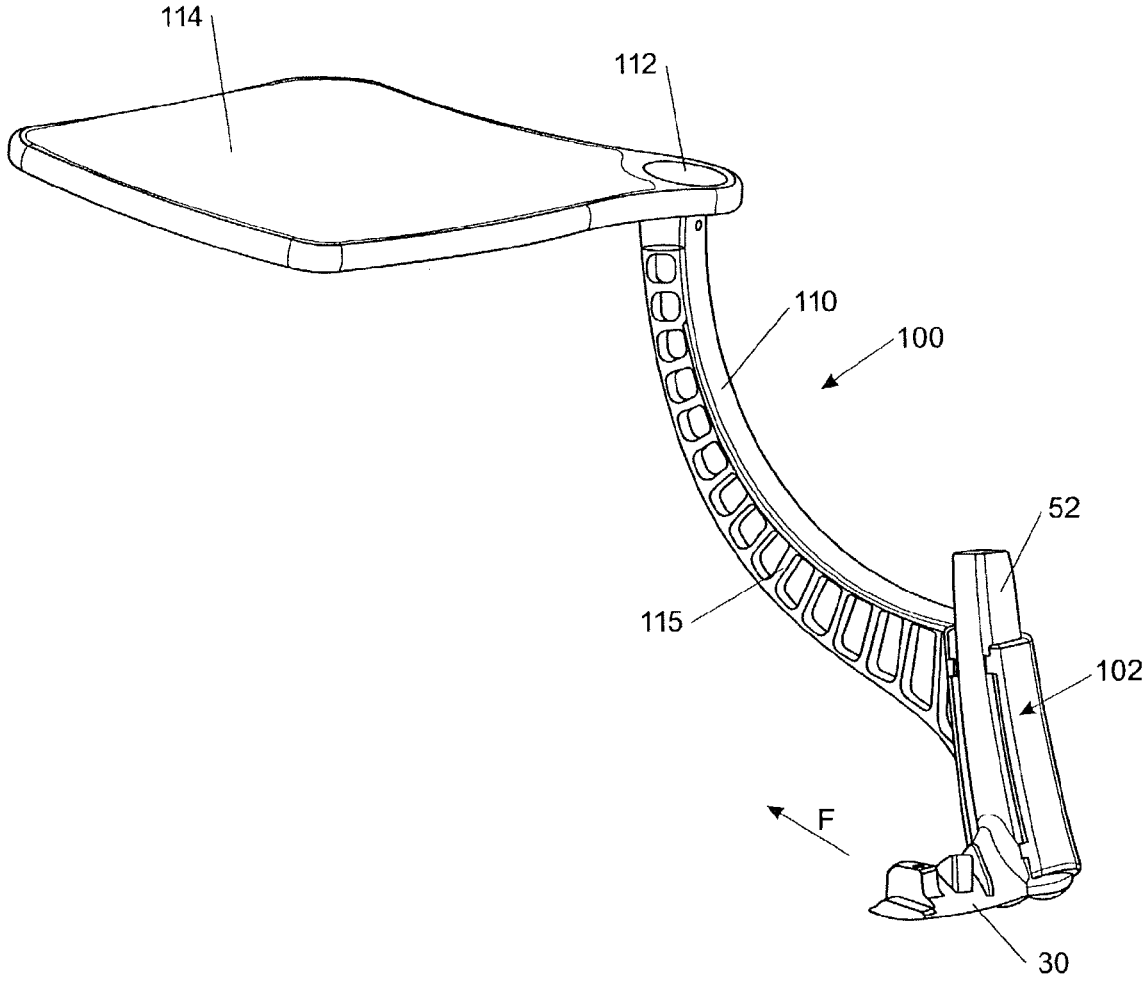
FIG. 2 is a rear perspective view of a preferred support arm supporting a work surface from a tapered chair arm.

With reference to FIG. 2, a support arm generally indicated by reference numeral 100 is removably attached to the hollow lower stem 52 of an arm assembly which may be attached to the chair of FIG. 1.

The chair arm shown in the Figures is the right side chair arm, and the forward direction (from the point of view of a chair occupant) is indicated by arrow F.

Figure 3:
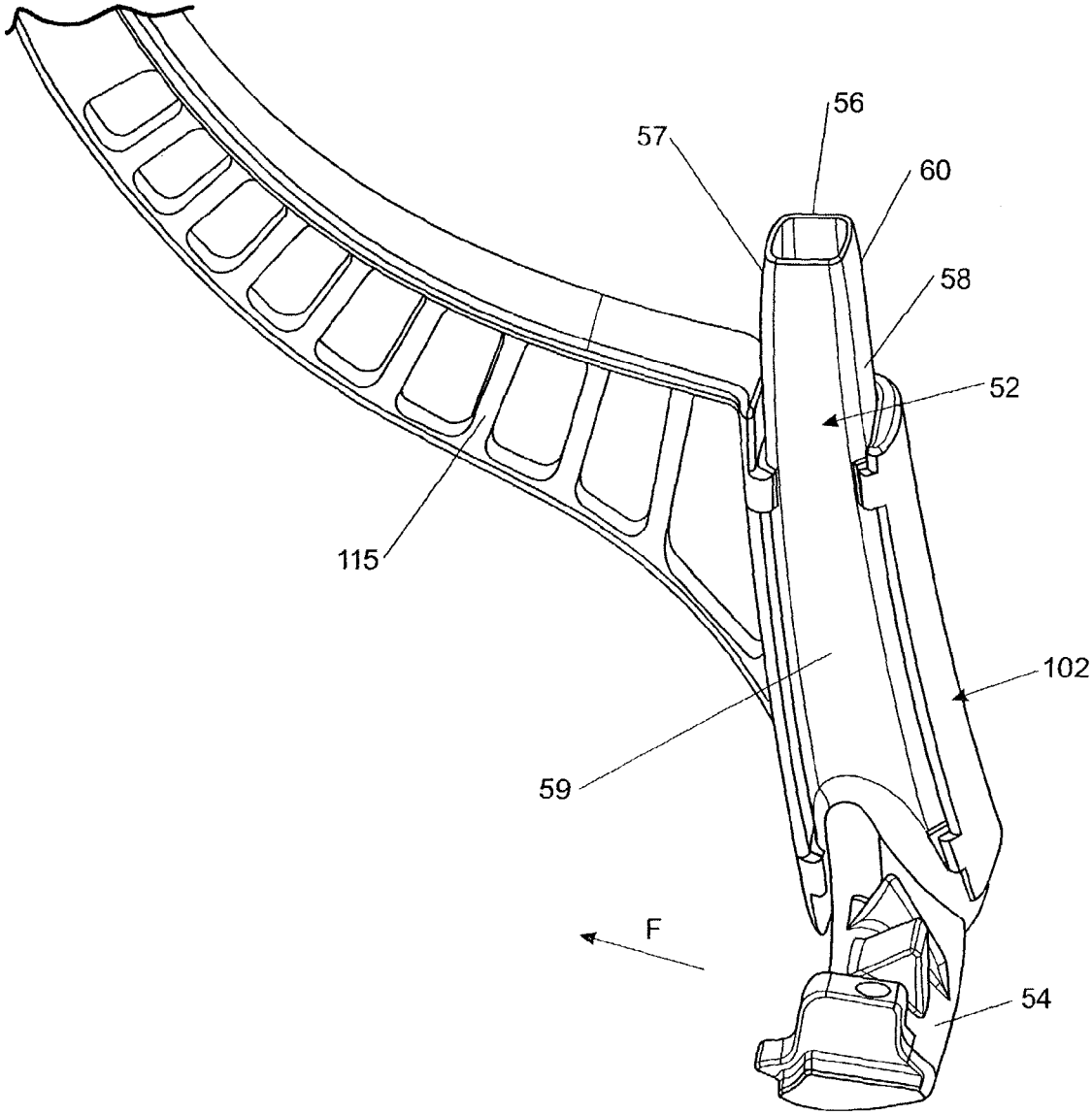
FIG. 3 is a side perspective view showing the attachment portion of the support arm of FIG. 2 attached to a tapered chair arm.

As can be seen more clearly from FIG. 3, the lower stem 52 is tapered towards its upper end 56 with a small included angle between its front surface 57 and rear surface 58. Preferably, the left and right side surfaces 59, 60 also have a small included angle. The hollow lower stem 52 is substantially square in cross section, and is provided with rounded corners between each adjacent outer surface. While the lower stem 52 is substantially square in cross section, it is not necessary that the front, rear, left and right surfaces are planar. For example, the surfaces may be slightly curved outwardly, or could include two surface portions arranged at a slight non-planar angle to one another.

Figure 4:
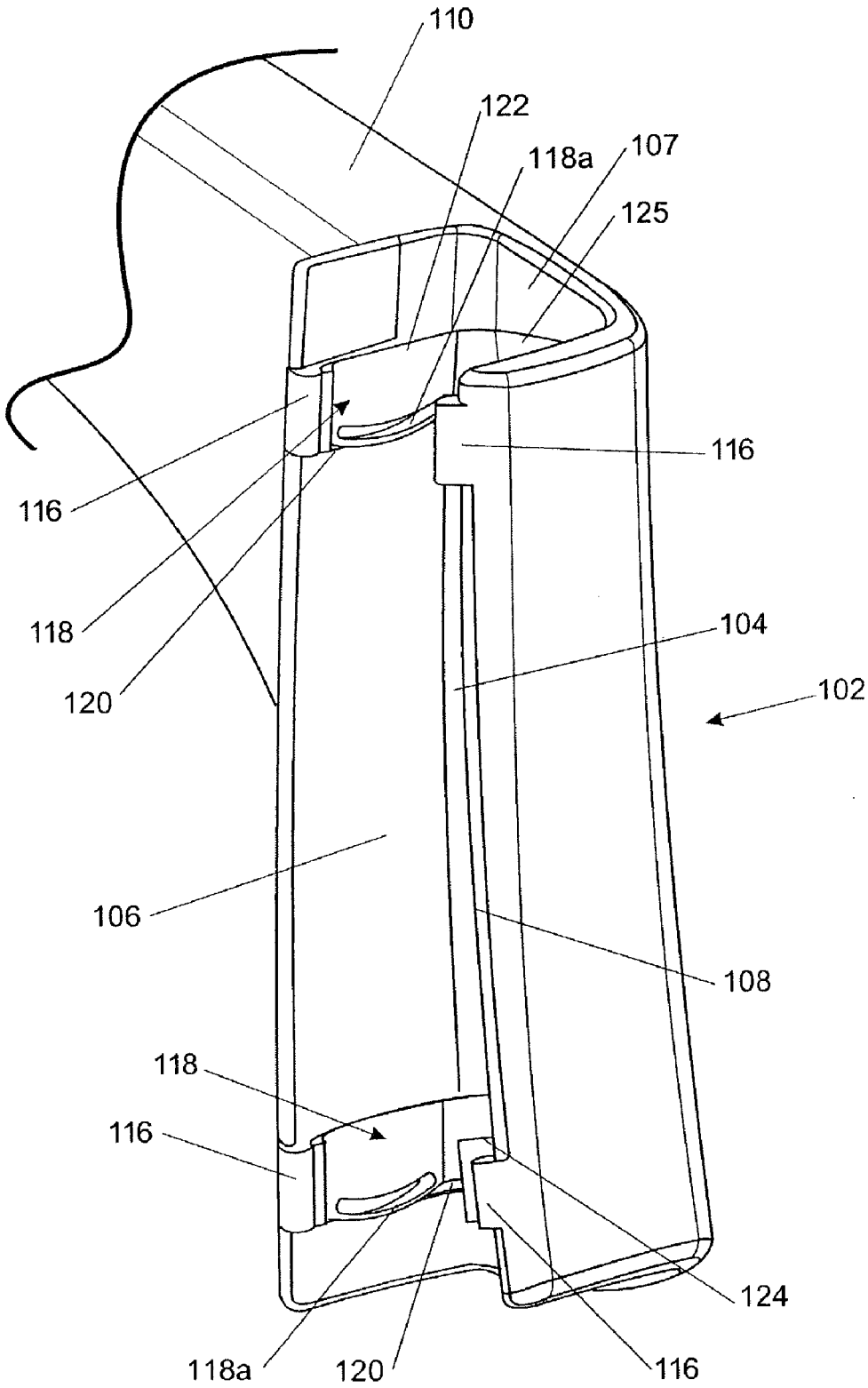
FIG. 4 is a detailed view of the interior of the attachment portion of the support arm of FIG. 2.

Referring to FIG. 4, the support arm 100 includes an attachment portion 102 which is substantially "C" shaped in cross section and defines a channel 104, the front surface 106 and rear surface 108 of which are tapered towards their upper ends. Additionally, the side surface 107 and the inner surfaces of the protrusions 116 (the function of which is described below) are preferably tapered. By providing tapered side surfaces on the tapered member and in the attachment portion 102, additional stability is provided to the support arm when engaged to the tapered member. Again, it is not necessary for the front 106, rear 108 and side surfaces to be planar, and they could be configured in the same manner as the surfaces of the lower stem 52 as described in the previous paragraph for example.

Reverting to FIG. 2, a proximal end of an arm portion 110 is attached to the attachment portion 102 of the support arm 100, and the arm portion 110 curves upwardly from the attachment portion and has an arrangement 112 for mounting an item at or toward its distal end, which will be described in more detail below with reference to FIG. 6. Attached to the arrangement 112 for mounting an item is a work surface in the form of a tablet 114.

The arm portion 110 may be in any form but in the preferred embodiment includes a plurality of transversely-extending strengthening ribs 115 along its length.

As the lower stem 52 of the chair arm and the interior of the attachment portion 102 are tapered towards their upper ends, in order to engage the attachment portion on the lower stem 52, the attachment portion 102 may be brought into contact with the lower stem 52 from the side so that the lower stem is located in the channel 104 of the attachment portion 102. Lowering the support arm 100 relative to the chair arm causes the attachment portion 102 to engage with the lower stem 52 in a taper lock. In order to disengage the attachment portion from the lower stem 52, the attachment portion is raised relative to the lower stem 52, and may then be removed to the side.

In order to further prevent the attachment portion 102 from being removed from the lower stem 52 when the tapered portions are engaged, the attachment portion includes a plurality of protrusions 116 (as shown in FIG. 4) which are sized to make it more difficult for the attachment portion to be removed in a sideways manner when the attachment portion 102 is lowered on the stem 52, but when the attachment portion 102 is raised relative to the lower stem 52, the attachment portion can be removed from engagement with the stem 52 by sliding the narrower upper portion of the stem 52 through the spaces between the protrusions 116.

In the preferred embodiment shown in FIG. 4, the interior of the attachment portion includes a pair of spaced release shuttles 118, which are of a substantially "C" shape to removably receive therein the lower stem 52 of the chair arm. The release shuttles are made from a polymer material, such as self-lubricating nylon, and are biased upwardly relative to the attachment portion 102 by integral leaf springs 118*a* extending between the lower edge of each shuttle and a respective stop 120 formed integrally in the interior of the attachment portion 102. The stops 120 also define the lowest point of travel of each shuttle 118. Therefore, when the support arm 100 is not attached to a chair arm, each shuttle 118 will be spaced upwardly from its respective stop 120 by virtue of the springs. It will be appreciated that the leaf springs need not be integral, and that other types of biasing devices could be used, such as compression springs.

The ends of the substantially "C" shape of each shuttle extend so as to make it more difficult for the attachment portion to be removed in a sideways manner from the lower stem 52 when the attachment portion is lowered on the chair arm, but which enable the attachment portion to be removed from the chair arm in a sideways manner when the attachment portion 102 is raised relative to the lower stem 52 so that the narrower upper portion of the stem can slide through the spaces between the ends of the substantially "C" shape.

Figure 5:
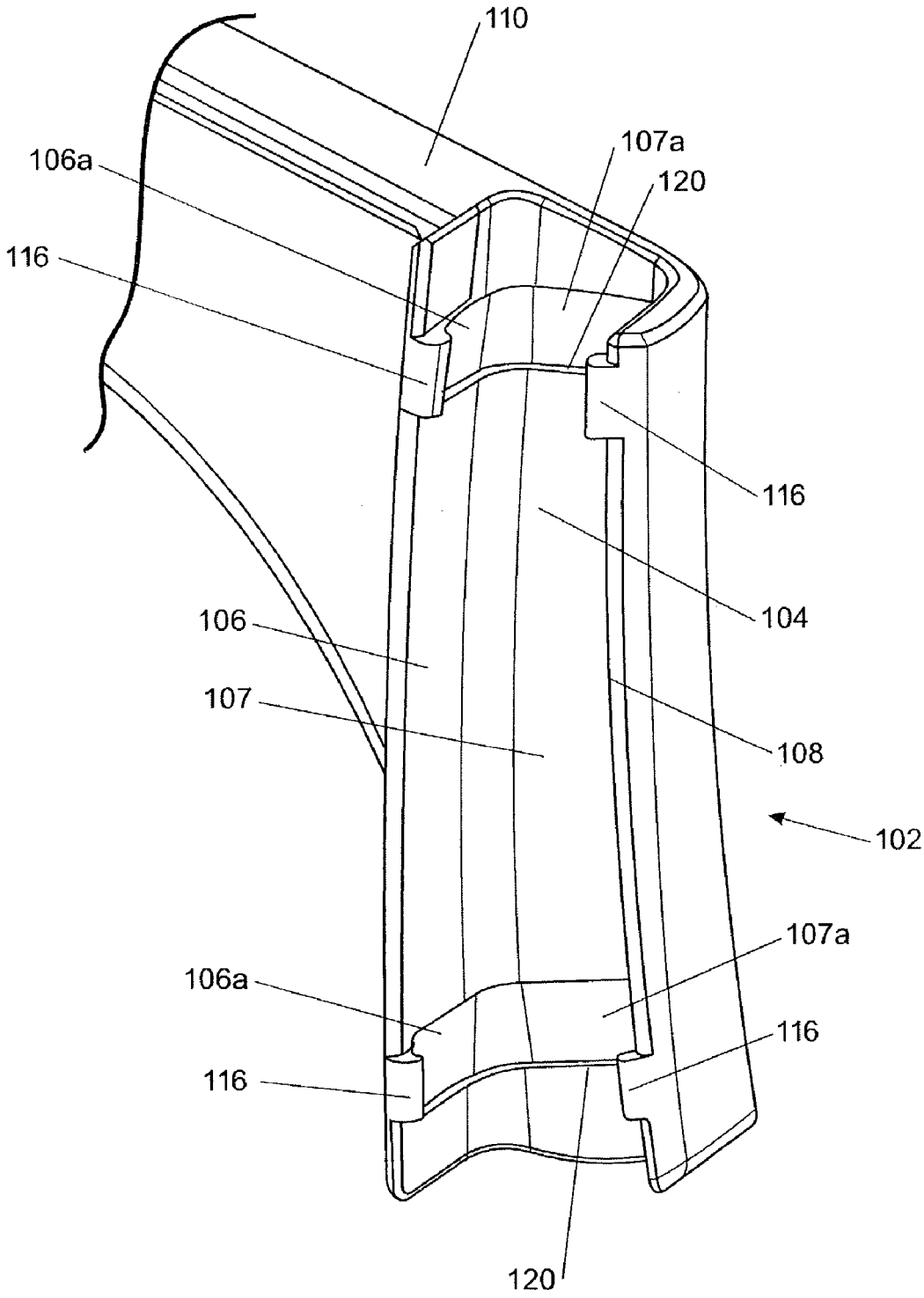
FIG. 5 is a detailed view similar to FIG. 4, but excluding the release shuttles.

The included angle between the front internal surface 122 and the rear internal surface 124 of each release shuttle 118 preferably substantially corresponds to the included angle between the front outer surface 57 and rear outer surface 58 of the hollow lower stem 52 of the chair arm. The preferred included angle of each is about 2 to 3 degrees. The included angle between the outer surfaces of each release shuttle is preferably substantially the same as the included angle between the front inner surface 106*a* and the rear inner surface 108*a* of the attachment portion 102 in the region of the each release shuttle (see FIGS. 5 and 10), which included angles are advantageously greater than that between the front internal surface 122 and rear internal surface 124 of each release shuttle 118. In the preferred embodiment, the included angle between the front surface 106*a* and rear surface 108*a* of the attachment portion in the region of each release shuttle (and also between the outer surfaces of the shuttles) is about 14 degrees. This facilitates easy removal of the attachment portion 102 from the lower stem 52.

As mentioned above, as well as the front and rear surfaces of each component being tapered, the side surfaces are preferably also tapered to improve stability. In the embodiment having the release shuttles, the included angle between the internal side surfaces (i.e. surface 125 and the inner surfaces of the ends of the "C" shape) of each release shuttle is preferably about 2 to 3 degrees, and the included angle between the outer surfaces of the release shuttles is greater, and preferably about 14 degrees. Similarly, the internal surface 107*a* in the region of each release shuttle and the internal surfaces of the projections 116 preferably have an included angle of about 14 degrees.

With the release shuttles mounted in the attachment portion, when the attachment portion is attached to a tapered member, the shuttles engage the tapered member and the remaining internal surfaces 106, 107, 108 in the attachment portion simply provide a clearance around the tapered member.

When the support arm 100 is to be attached to a chair arm, the support arm 100 is moved in a sideways manner so that the hollow lower stem 52 of the chair arm is loosely received in the release shuttles 118 of the attachment portion 102 of the support arm 100. The attachment portion 102 is then lowered downwardly relative to the stem 52 so that part of the tapered inner surfaces 122, 124 of each release shuttle 118 engage the tapered outer surfaces 57, 58 of the stem 52 (and the tapered inner side surfaces of the release shuttles at least partly engage the tapered side surfaces of the tapered member if applicable). In this configuration the release shuttles 118 will be spaced upwardly from their respective stops 120 on the springs 118*a*.

When a user wishes to remove the support arm 110 from the chair arm, the support arm 100 and therefore the attachment portion 102 are moved upwardly relative to the lower stem 52 of the chair arm. As this movement occurs, initially part of the inner surfaces 122, 124 of the release shuttles will remain in contact with the surfaces 57, 58 of the stem 52 (and part of the inner surface 125 and the inner surfaces of the ends of the "C" shape will initially remain in contact with the outer side faces of the tapered member if those surfaces are tapered). As the attachment portion 102 is moved upwardly, by virtue of the contact between the release shuttles 118 and the lower stem 52, the release shuttles will move downwardly relative to the attachment portion against the force of the springs, towards their respective stops 120. The movement of the release shuttles towards their stops is enhanced by virtue of the greater included angle of the inner walls 106, 108 of the attachment portion 102 and outer walls of the shuttles 118, relative to the inner walls 122, 124 of the shuttles and outer walls of the lower stem 52. The release shuttles 118 will then snap out of engagement with the lower stem 52, following which the attachment portion 102 may be moved further upwardly relative to the lower stem 52, and once the attachment portion 102 has been moved upwardly a sufficient distance that the lower stem 52 can fit through the clearance between the ends of the substantially "C" shaped release shuttles 118 and the protrusions 116 of the attachment portion, the attachment portion can be moved in a sideways manner relative to the lower stem 52 to fully disengage it therefrom.

The spring-loaded release shuttles are particularly useful where the taper of the tapered member is slight, as if an attachment portion having a corresponding slight taper was attached directly, those parts would be difficult to separate. However, they are not essential to the functioning of invention, especially when larger tapers are used, in which case the internal surfaces of the attachment portion could engage directly with the tapered member.

Figure 6:
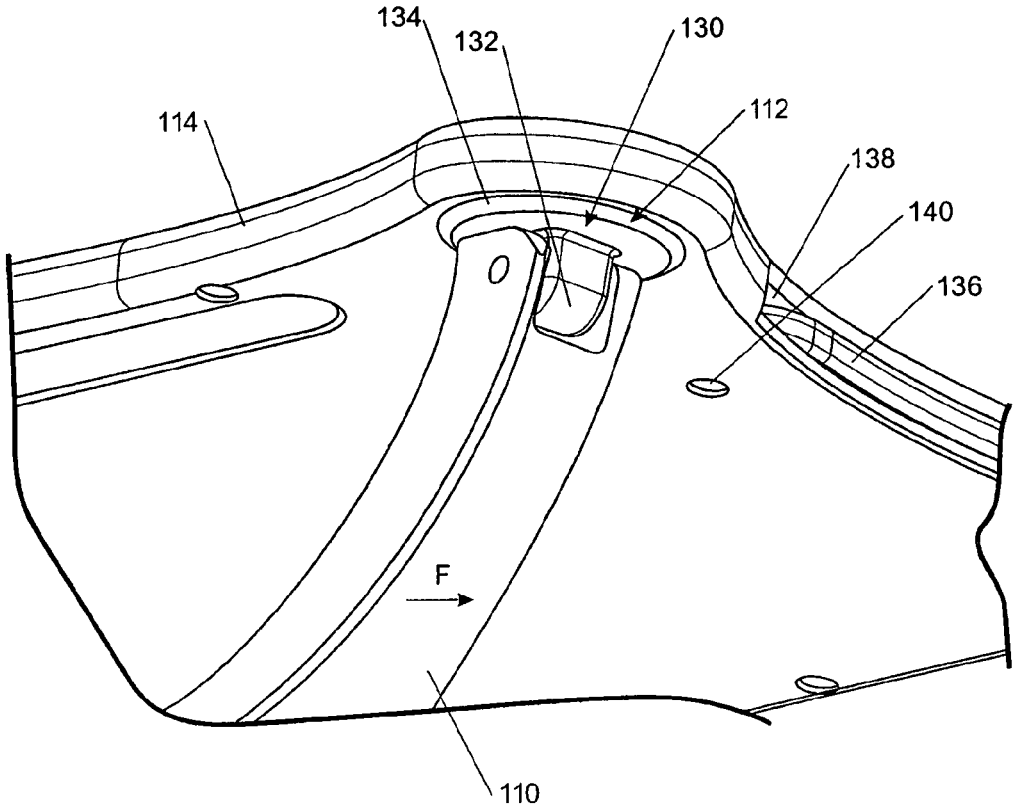
FIG. 6 shows an arrangement for mounting the work surface on the support arm of FIG. 2.

With reference to FIG. 6, the upper, or distal, end of the support arm 110 includes an arrangement 112 for mounting an item thereto as mentioned above. The arrangement 112 for mounting an item is in the form of a joint 130 which is pivotally connected to the upper end of the support arm 110 by means of a pivot 132. A work surface which is in the form of a tablet 114 is rotatably attached to a part 134 of the joint. It can be seen that the pivoting axis is substantially aligned with the forward-rearward direction of the chair, and the rotation of the tablet 114 on the joint is about a substantially vertical axis.

The work surface 114 is indexed for rotation on part 134 of the joint such that the tablet may be rotated up to about 20° towards the chair occupant and up to about 30° so away from the chair occupant. The indexing movement is provided by detents (not shown) within the joint.

Part 134 includes a lower flange (visible in FIG. 6) and an upwardly-extending boss (not shown) upon which the work surface 114 is rotatably mounted. The work surface is maintained thereon by a fastening member 135 having a threaded portion (not shown) screwed into the boss of part 134 and an upper flange (visible in FIG. 8), the work surface being sandwiched between the lower flange of part 134 and upper flange of the fastening member 135. In the preferred embodiment, part 134 is made of a self-lubricating plastic material such as nylon, and the fastening member 135 is made of aluminum.

Figure 7:
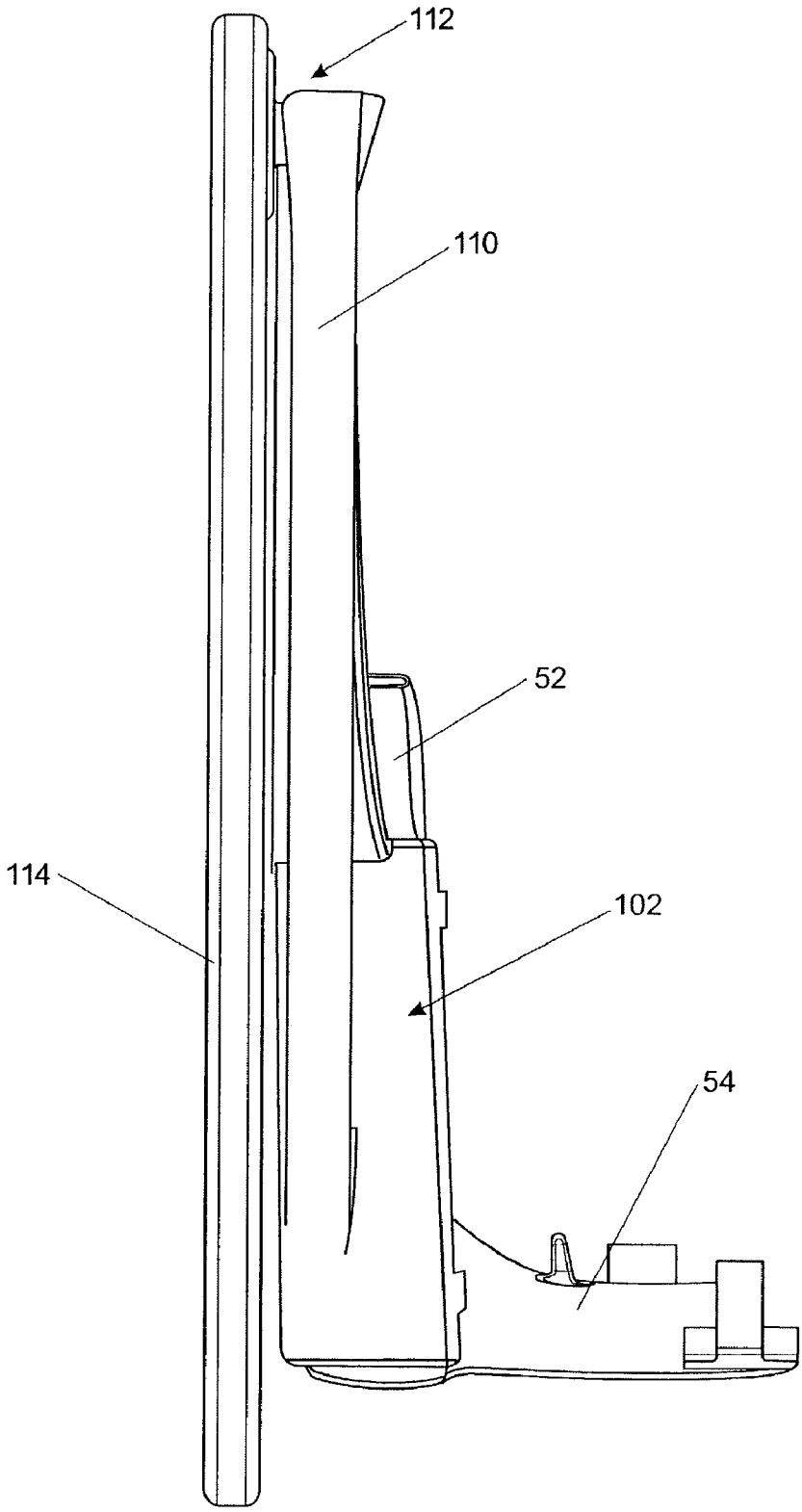
FIG. 7 is a front view of the support arm and work surface of FIG. 2, with the work surface in a folded configuration.

The pivoting and rotating joint 130 enables the tablet 114 to be moved from an in-use position in front of a chair occupant to a position adjacent the outside of the arm portion 110, as shown in FIG. 6. This may be achieved in one of two ways. When a user wishes to move the tablet 114 to the position shown in FIG. 7, they may either simply pivot the tablet 114 into an upstanding vertical orientation about the pivot 132, at which time it will fall and rotate about the joint 130 under the influence of gravity to the position shown in FIG. 7. Alternatively, the user may rotate the tablet 114 away from them further greater than the 30° indexed movement. Once the tablet has been rotated sufficiently, gravity will cause it to pivot about pivot 132 to the position shown in FIG. 7.

As well as the pivoting and rotating motion outlined above, the work surface may be slidable in a forward and rearward and/or left and right direction. It may also be height adjustable if desired. Further, rather than providing a pivoting and rotating joint at the distal end of the support arm 110, a lower cost alternative is to provide a fixed item at the distal end of the support arm. Alternatively, the item attached to the distal end of the support arm may be removable and replaceable with another item, and for this purpose a "quick release" mechanism may be provided.

Figure 8:
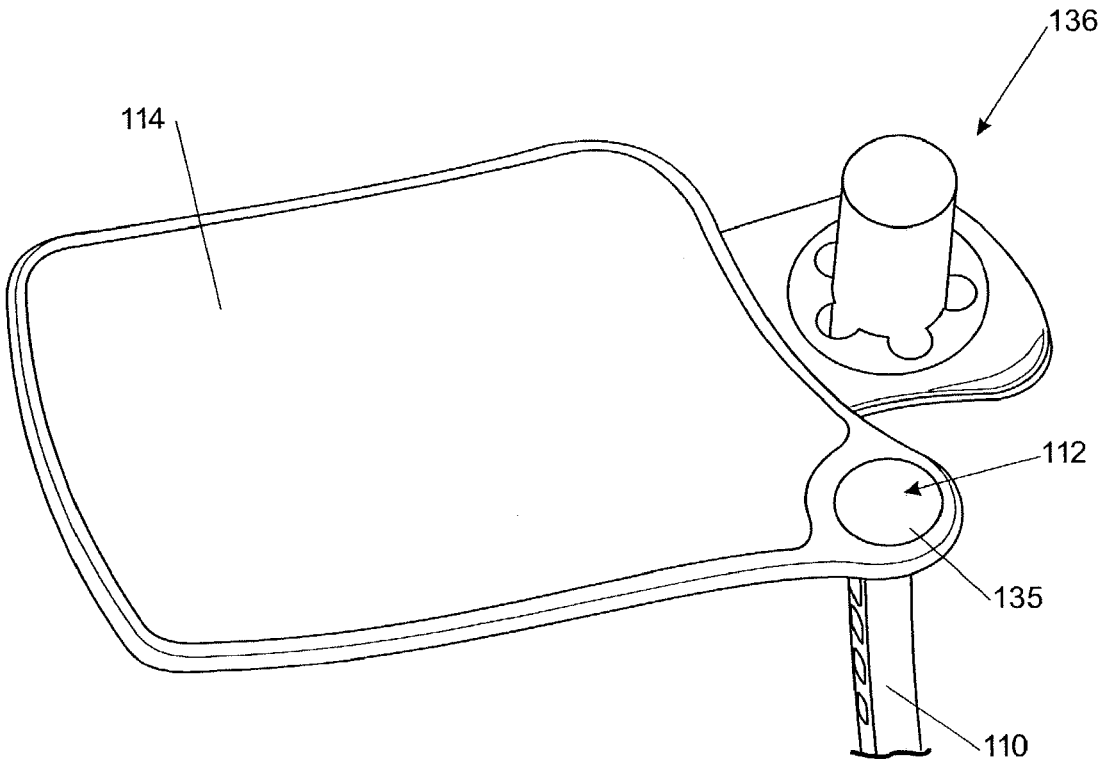
FIG. 8 is an overhead perspective view of the support arm and work surface of FIG. 2, including a cup holder extending from a recess therein.
Figure 9:
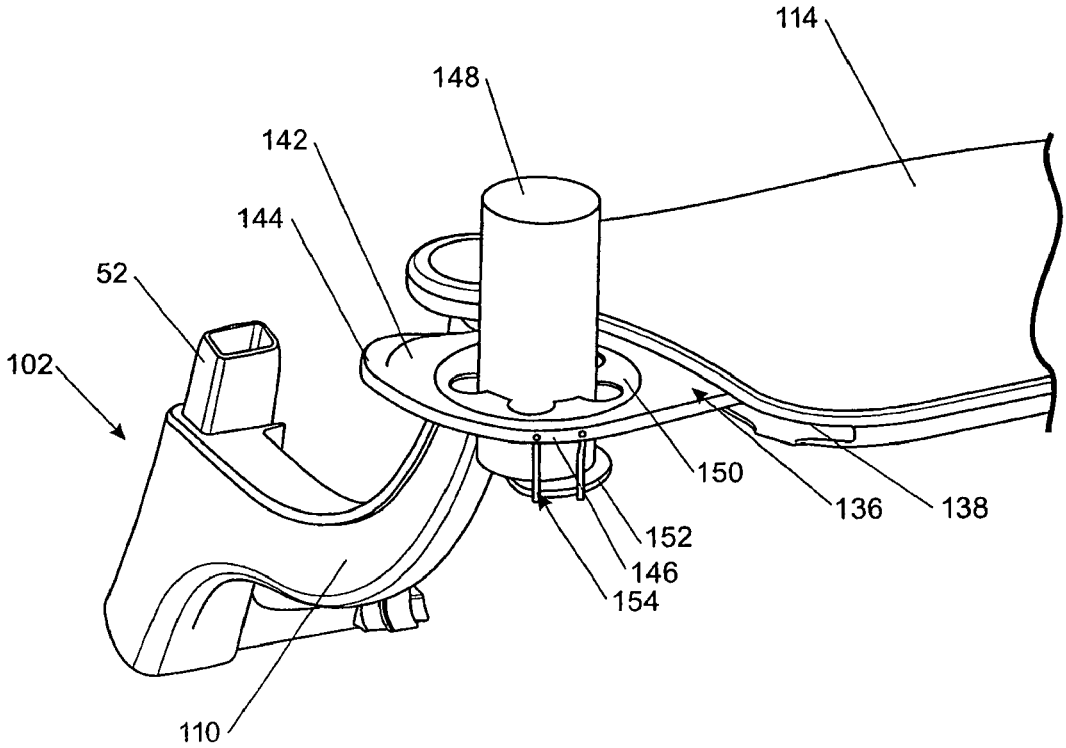
FIG. 9 is a front perspective view showing details of the cup holder of FIG. 8.

Referring to FIGS. 8 and 9, the tablet 114 includes a cup holder indicated generally by reference numeral 136, to hold a cup, glass, tumbler or the like. As shown in FIG. 9, a recess 138 is provided in the side of the tablet, the cup holder 136 being arranged to move from a position located in the recess as shown in FIG. 6, to a position located adjacent the tablet as shown in FIGS. 8 and 9. The cup holder 136 is pivotally connected to the tablet 114 via a pivot 140 as shown in FIG. 6. Alternatively, the cup holder may be arranged to slide outwardly from within the recess 138 in a linear manner.

The cup holder 136 includes a substantially planar portion 142 with a gripping protrusion 144 extending from an edge thereof, to enable a user to grip and pull the cup holder outwardly from within the recess. The substantially planar portion defines an aperture 146 in which the cup, glass, tumbler or the like may be located. An elastomeric section 150 is provided in the recess 146, the elastomeric section enabling cups of different sizes to be held in the cup holder in a stabilized manner.

The cup holder also includes a base portion 152 upon which the cup or the like rests. The base portion 152 is pivotally connected to the substantially planar portion 142 to enable the base portion 152 to move between a position spaced from the substantially planar portion when the cup holder is in use, to a position adjacent the substantially planar portion 142 so that the cup holder may be moved back into the recess 138. The pivotal connection is provided by a 4-bar linkage indicated generally by reference number 154. As the cup holder is pivoted inwardly towards the recess 138, the lower edge of the recess 138 acts against one or two bars of the 4-bar linkage, moving the base part 152 to a position adjacent the substantially planar part 142 as the cup holder is moved back into the recess 138.

Figure 10:
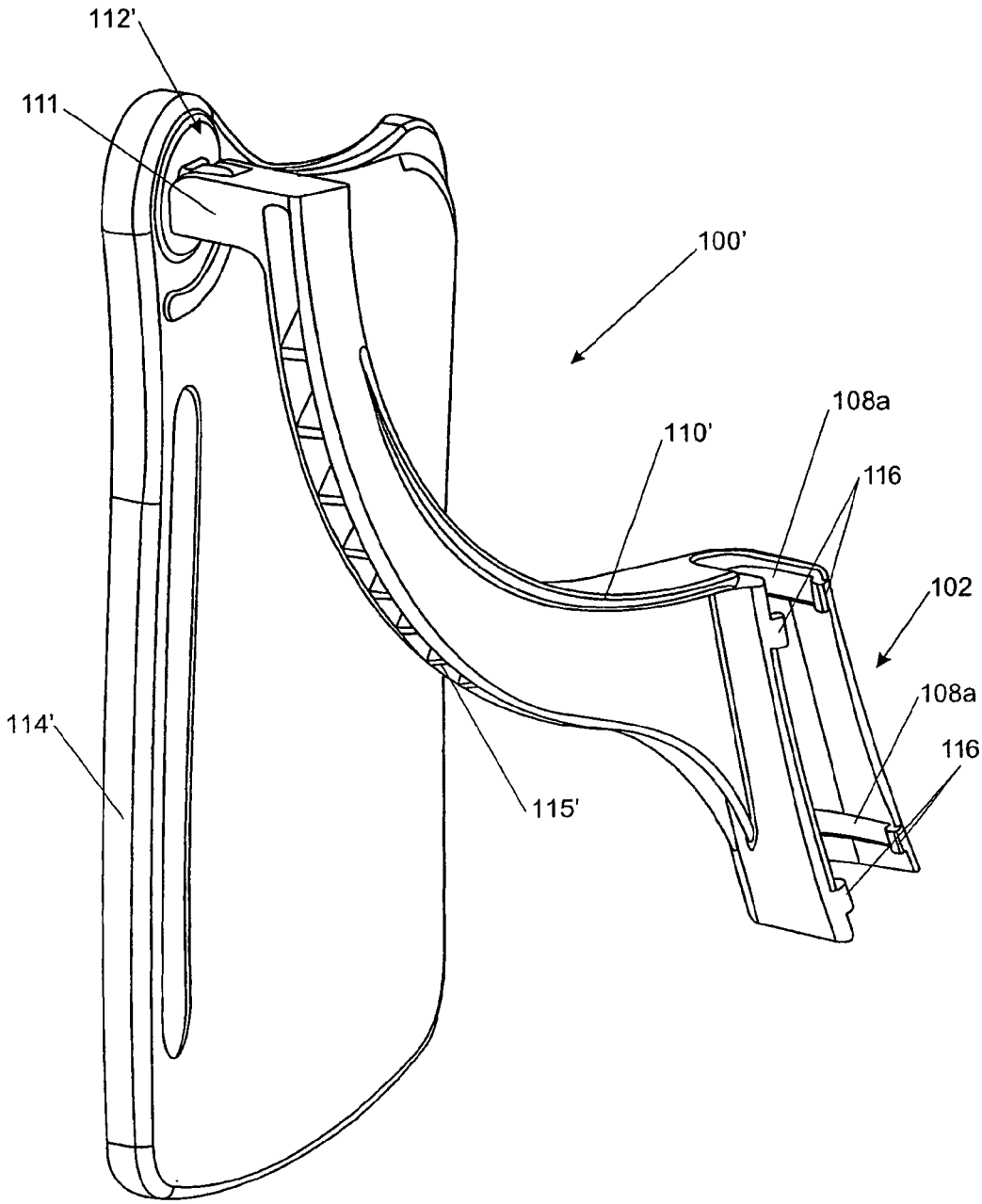
FIG. 10 is a front view of an alternative preferred support arm and work surface, with the work surface in a folded configuration.
Figure 11:
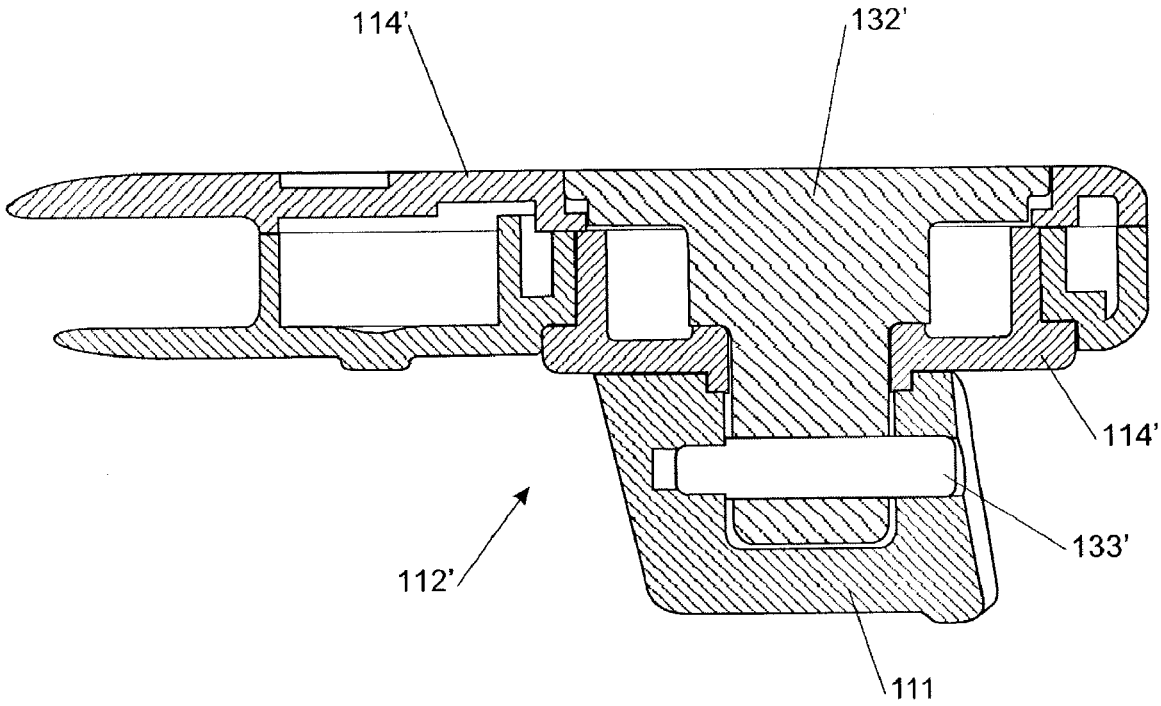
FIG. 11 is a sectional view of the arrangement for mounting the work surface on the support arm of FIG. 10.

An alternative preferred embodiment support arm 100' is shown in FIGS. 10 and 11. Unless described below, the features should be considered to be the same as those of FIGS. 2 to 9, and like reference numerals are indicated by like parts. Differences are indicated with a prime (′). The differences in the alternative embodiment support arm 100' shown in FIGS. 10 and 11 are as follows. Firstly, the ribs 115' are provided internally in the arm portion 110', and the arm portion 110' has solid sides. Further, the arm portion 110' is provided with a transverse projection 111 at its distal end to provide a dogleg configuration. The arrangement 112' for mounting an item is pivotally connected at or adjacent the distal end of the projection 111. An advantage of this configuration is that it provides additional clearance between the arm portion 110' and the tablet 114' when the tablet is in the folded storage configuration shown. Further, the dogleg configuration provides additional clearance between the top of the armrest and the tablet 114' in its storage configuration, meaning the tablet will not interfere with an occupant's arm in that configuration. The additional clearance is also particularly useful when the armrest is moveable transversely, so that the hanging tablet does not interfere with the outward transverse movement of the armrest. The tablet 114' is also wider than that shown in the other Figures, as it will be appreciated that the projection 111 extends outwardly from the side of the chair, and the tablet 114' is pivotally attached at or adjacent the end of the projection 111.

The arrangement 112' for mounting an item in the embodiment in FIGS. 10 and 11 provides the same functionality as that of FIG. 6, but is assembled in a different way. In this embodiment, the pivoting and rotating joint is provided by a one-piece upper flange and connector 132' extending downwardly through the work surface 114', and a separate washer 134' is provided to surround the connector 132' and seats against the underside of the work surface. When the connector 132' is pivotally attached to the projection 111 of the arm portion 110' via a pin 133', that maintains the joint in the assembled configuration, as the washer 134' cannot be removed from the connector 132' without removing the pin 133' and moving the connector 132' away from the arm portion.

The above describes particular examples of the present invention, and modifications can be made thereto without departing from the scope of the invention.

For example, while the lower stem 52 of the chair arm is described as being substantially square in cross section, it could be of different shape. For example, the cross sectional shape could be elliptical, or other polygonal shapes. Further, the arm could be another eccentric shape which prevents rotation of one component relative to the other. A circular component could also be used, although it would be necessary to provide means for preventing rotation of one component relative to the other, such as a protrusion in the attachment portion with engages in a notch or a slot in the chair arm, or vice-versa.

An important feature with any of these shapes is that in cross section the interior of the attachment portion 102 substantially corresponds in shape to part of the outer shape of the stem 52 of the chair, so that they can engage. It is desirable that an open portion is provided in a side of the attachment portion so that the attachment portion can be attached and detached in a sideways manner.

The support arm described above has a tablet work surface attached to the distal end thereof. However, the support arm is suitable for supporting other items, such as a mouse pad, a workbox for containing pens etc, a keyboard, a notebook computer, or a cup holder. These could be pivotally or fixedly attached to the support arm 110. Further, these components could be interchangeable on the support arm, and a "quick release" mechanism may be provided to facilitate easy changing of the components.

The support arm 110 shown in the Figures is for attachment to the right side chair arm of an office chair. However, it will be appreciated that a support arm of opposite configuration could be provided for attachment to a left chair arm, which would be more suitable for a left-handed chair occupant. However, the indexed rotation of the tablet 114 means that the tablet can be rotated towards the chair occupant, which would be more suitable for a left-handed user to write on the tablet when it is attached to the right arm of a chair.

The preferred support arm is described and shown as including release shuttles 118. Rather than using a pair of release shuttles, a single shuttle could be used for example towards a lower end of the attachment portion. In such an embodiment, the included angle between the internal surfaces of the attachment portion could be greater than the included angle between the internal surfaces of the faces of the shuttle.

Further, in embodiments in which larger tapers are used, the release shuttles are not essential, and the inner surfaces of the attachment portion may be engaged directly with the chair arm. In this embodiment, the included angle between the inner surfaces of the attachment portion preferably substantially corresponds to the included angle of the chair arm. The included angles may be the same, or variations of about plus or minus 5 degrees may be acceptable.

In the embodiment having release shuttles, the taper of the internal surfaces of the release shuttles is described as corresponding substantially to the taper of the chair arm. The included angles could be the same, or variations of about plus or minus 5 degrees may be acceptable. Similarly, the taper of the outer surfaces of the release shuttles could vary by a similar amount from the taper of the inner surfaces of the attachment portion.

The included angles described for the external surfaces of the tapered member, the internal surfaces of the release shuttles, the external surfaces of the release shuttles, and the internal surfaces of the attachment portion in the regions of the release shuttles are the preferred angles, but could be varied. For example, the included angles between the outer surfaces of the tapered member and between the inner surfaces of the release shuttles could be between about 1 and 14 degrees (and there could be a variation between the surfaces as outlined above). The included angles between the outer surfaces of the release shuttles and between the inner surfaces of the attachment portion in the regions corresponding to the release shuttles should be greater, but could be between about 10 and 45 degrees for example, and more preferably between about 10 and 25 degrees for example (and there could be a variation between the surfaces as outlined above).

The support arm is described above as being attachable to a tapered part of a chair arm. However, it will be appreciated that the support arm assembly may be used to support items from other tapered components, for example, other furniture components.

The preferred embodiment support arms described above provides a number of advantages.

The support arms may be attached to, and detached from, a tapered member quickly and without the use of tools by virtue of the tapered interior of the attachment portion.

The release shuttles enhance the removal of the support arms from tapered member, and are particularly useful when a relatively small taper is present on the chair arm, as if an attachment portion having a corresponding small taper was directly engaged with the chair arm, they would be difficult to separate, possibly requiring the use of a hammer to achieve this.

The pivoting and rotating joint between the arm portion and item which is being supported enables the item which is being supported to be easily moved from an in-use position to a storage position, enabling a chair occupant to easily egress the chair. This provides safety advantages over permanent or semi-permanent tablet attachments.

The rotation of the joint provides easy adjustment for users of different sizes, and enables the item to be positioned to suit individual users. Further, having an item such as a work surface pivoted towards a chair occupant may enable the work surface attached to the right arm of a chair to be comfortably used by a left-handed person.

What is claimed is:

1. A furniture component comprising:

a support arm for supporting an item from a tapered member of a further furniture component, the support arm comprising:

an arm portion having a proximal end and a distal end;

an arrangement for mounting an item substantially at the distal end; and an attachment portion substantially at the proximal end and which defines an internal taper, whereby the support arm is engageable on the tapered member in a taper lock between the tapered member and the attachment portion and disengageable manually and without the use of tools, to mount the support arm to the tapered member.

2. A furniture system comprising:

a furniture component as claimed in claim 1; and a further furniture component including a tapered member, the attachment portion of the support arm of the furniture component being engaged on the tapered member, the tapered member defining a taper, wherein the internal taper of the attachment portion of the support arm of the furniture component substantially corresponds to the taper of the tapered member of the further furniture component.

3. A furniture component as claimed in claim 1, wherein the internal taper in the attachment portion of the support arm converges towards its upper end, so that moving the attachment portion downwardly relative to a tapered member that converges towards its upper end, engages the respective tapers together.

4. A furniture component as claimed in claim 1, wherein the interior of the attachment portion has a cross-sectional shape configured to engage with a tapered member having a non-circular cross section, so that rotation between the attachment portion and tapered member is inhibited when the tapers are engaged.

5. A furniture component as claimed in claim 1, wherein the arm portion is curved upwardly from the attachment portion such that an item mounted to the arrangement for mounting an item is located above and forward of the attachment portion when the support arm is attached to a tapered member.

6. A furniture component as claimed in claim 1, wherein the attachment portion has an open part so that the interior of the attachment portion may be engaged with a tapered member having a longitudinal direction, by moving the attachment portion in a direction that is generally transverse to the longitudinal direction of the tapered member, and then sliding the attachment portion along the tapered member so that the tapers engage.

7. A furniture component as claimed in claim 6, wherein the open portion of the attachment portion comprises an open side so that the interior of the attachment portion may be engaged with the tapered member by moving it into contact from the side of the tapered member, and then sliding the attachment portion along the tapered member so that the tapers engage.

8. A furniture component as claimed in claim 6, wherein the attachment portion is substantially "C" shaped in internal cross section.

9. A furniture component as claimed in claim 8, wherein the attachment portion includes protrusions extending from the edges of the substantially "C" shape, partially across the open part, to define one or more spaces between the protrusion, the protrusions sized to make it more difficult for the attachment portion to be removed in a sideways manner from the tapered member when the tapered member and attachment portion are engaged, but to allow the attachment portion to be removed through the spaces between the protrusions when the tapered member and attachment portion are not engaged.

10. A furniture component as claimed in claim 1, wherein the interior of the attachment portion includes one or more release shuttles, each of the one or more release shuttles being slidable relative to the attachment portion and arranged to engage the outer surface of the tapered member when the tapered member and the attachment portion are engaged.

11. A furniture component as claimed in claim 10, wherein the attachment portion is substantially "C" shaped in internal cross section, and the or each release shuttle is substantially "C" shaped.

12. A furniture component as claimed in claim 11, wherein the or each release shuttle has spaced apart ends and wherein the spaced apart ends of the release shuttles each define a space and wherein the ends of the substantial "C" shape of the or each shuttle extends so as to make it more difficult for the attachment portion to be removed in a sideways manner from the tapered member when the tapered member and attachment portion are engaged, but to allow the attachment portion to be removed through the spaces between the ends of the or each shuttle when the tapered member and attachment portion are not engaged.

13. A furniture component as claimed in claim 12, wherein the attachment portion includes protrusions extending from the edges of the substantially "C" shape, and the or each release shuttle is substantially aligned with respective protrusions extending from the substantially "C" shaped attachment portion.

14. A furniture system comprising:

a furniture component as claimed in claim 10; and a further furniture component including a tapered member, the attachment portion of the support arm of the furniture component being engaged on the tapered member, wherein the tapered member of the further furniture component has front and rear outer surfaces with an included angle between the front and rear outer surfaces and the or each release shuttle of the furniture component has front and rear inner surfaces with an included angle between the front and rear inner surfaces, and wherein the included angle between the front and rear inner surfaces of the or each release shuttle substantially corresponds to the included angle between the front and rear outer surfaces of the tapered member.

15. A furniture system as claimed in claim 14, wherein the included angle between the front and rear inner surfaces of the or each release shuttle is about 2 to 3 degrees.

16. A furniture component as claimed in claim 10, wherein the or each release shuttle has front and rear inner surfaces with an included angle between the front and rear inner surfaces, and front and rear outer surfaces with an included angle between the front and rear outer surfaces, and the attachment portion in the region of the or each release shuttle has front and rear inner surfaces with an included angle between the front and rear inner surfaces, and wherein the included angle between the front and rear inner surfaces of the attachment portion in the region of the or each release shuttle, and the included angle between the front and rear outer surfaces of the or each release shuttle, is greater than the included angle between the front and rear inner surfaces of the or each release shuttle.

17. A furniture component as claimed in claim 16, wherein the included angle between the front and rear outer surfaces of the or each release shuttle, and the included angle between the front and rear inner surfaces of the attachment portion in the region of the or each release shuttle, is about 14 degrees.

18. A furniture system comprising:

a furniture component as claimed in claim 10; and a further furniture component including a tapered member, the attachment portion of the support arm of the furniture component being engaged on the tapered member, wherein the tapered member of the further furniture component has side surfaces with an included angle between the side surfaces, and the or each release shuttle of the furniture component has side inner surfaces with an included angle between the side inner surfaces, and wherein the included angles between the side inner surfaces of the or each release shuttle substantially corresponds to the included angle between the side surfaces of the tapered member.

19. A furniture system as claimed in claim 18, wherein the included angle between the side inner surfaces of the or each release shuttle is about 2 to 3 degrees.

20. A furniture system as claimed in claim 18, wherein the or each release shuttle has side outer surfaces with an included angle between the side outer surfaces, and the attachment portion of the furniture component has side inner surfaces with an included angle between the side inner surfaces, and wherein the included angle between the side outer surfaces of the or each release shuttle, and the included angle between the side inner surfaces of the attachment portion in the region of the or each release shuttle, is greater than the included angle between the side inner surfaces of the or each release shuttle.

21. A furniture system as claimed in claim 20, wherein the included angle between the side outer surfaces of the or each release shuttle, and the included angle between the side inner surfaces of the attachment portion in the region of the or each release shuttle, is about 14 degrees.

22. A furniture component as claimed in claim 10, wherein all inner and outer surfaces of the or each release shuttle, and of the attachment portion in the region of the or each release shuttle, are tapered.

23. A furniture component as claimed in claim 22, wherein included angles between all opposing outer surfaces of the or each release shuttle, and between all opposing inner surfaces of the attachment portion in the region of the or each release shuttle, are greater than included angles between all opposing inner surfaces of the or each release shuttle.

24. A furniture component as claimed in claim 23, wherein the included angles between all opposing internal surfaces of the or each release shuttle are about 2 to 3 degrees.

25. A furniture component as claimed in claim 24, wherein the included angles between all opposing outer surfaces of the or each release shuttle, and between all opposing inner surfaces of the attachment portion in the region of the or each release shuttle, are about 14 degrees.

26. A furniture component as claimed in claim 10, wherein at least a substantial part of a remainder of the interior of the attachment portion, other than one or more regions corresponding to the one or more release shuttles, has an angle substantially corresponding to that of the tapered member.

27. A furniture component as claimed in claim 10, wherein the or each release shuttle is biased towards the tapered end of the attachment portion.

28. A furniture component as claimed in claim 27, wherein the or each release shuttle is biased by one or more compression springs.

29. A furniture component as claimed in claim 27, wherein the or each release shuttle is biased by one or more leaf springs.

30. A furniture component as claimed in claim 27, wherein the or each release shuttle is arranged such that as the attachment portion of the support arm is moved in the direction of its taper to detach it from the tapered member, the or each release shuffle initially moves with the tapered member, relative to the attachment portion, in a direction away from the taper and then snaps out of engagement with the tapered member to release the attachment portion from the tapered member.

31. A furniture component as claimed in claim 10, wherein the or each release shuttle has a respective stop provided in the interior of the attachment portion to limit the movement of the or each release shuffle in a direction away from the taper.

32. A furniture component as claimed in any claim 10, wherein the or each release shuffle is made of a plastics material.

33. A furniture component as claimed in claim 10, wherein the one or more release shuffles comprises two spaced apart release shuttles.

34. A furniture system comprising:

a furniture component as claimed in claim 1; and an item mounted on the arrangement for mounting, wherein the arrangement for mounting comprises a joint to which the item is attached.

35. A furniture system as claimed in claim 34, wherein the item is permanently mounted to the joint.

36. A furniture system as claimed in claim 34, wherein the position of the item is fixed relative to the arm assembly.

37. A furniture system as claimed in claim 34, wherein the joint is configured to allow pivoting and rotating movement of the item relative to the arm portion.

38. A furniture system as claimed in claim 37, wherein the joint allows movement of the item between a use position in which it extends in a substantially perpendicular manner from the arm portion and a storage position in which it hangs beside the arm portion.

39. A furniture system as claimed in claim 38, wherein the joint is indexed for rotation.

40. A furniture system as claimed in claim 39, wherein the joint is indexed for rotation such that the item may be rotated up to about 20 degrees towards a user and up to about 30 degrees away from the user in a substantially horizontal plane.

41. A furniture system as claimed in claim 40, wherein the joint is configured such that with the support arm attached to an arm of a chair, a chair occupant can pivot the item in a substantially vertical plane towards the side of the chair so that it falls under the influence of gravity to the outside of the arm portion, or can rotate the item towards the front of the chair a sufficient distance that it will then pivot under the influence of gravity to the outside of the arm portion.

42. A furniture component as claimed in claim 1, wherein the arm portion includes a projection at or towards the distal end thereof, thereby forming a dogleg configuration, with the arrangement to attach an item provided at or adjacent a distal end of the projection.

43. A furniture component as claimed in claim 1, wherein the arrangement for mounting an item is configured to allow sliding of an item mounted thereto in at least one dimension relative to the arm portion.

44. A furniture component as claimed in claim 43, wherein the item is slidable in two dimensions relative to the arm portion.

45. A furniture component as claimed in claim 1, wherein the arrangement for mounting an item comprises a joint to which the item is attachable.

46. A furniture component as claimed in claim 45, wherein the item is removable from the joint and interchangeable with a further item.

47. A furniture system comprising:

a furniture component as claimed in claim 1; and an item mounted on the arrangement for mounting, wherein the item is selected from the group comprising: a work surface or tablet, a work box for containing writing implements, a keyboard, a mouse pad, a notebook computer, and a cup holder.

48. A furniture system as claimed in claim 47, wherein the item is a work surface mounted at or adjacent the distal end of the arm portion.

49. A furniture system as claimed in claim 48, wherein the work surface is in the form of a tablet.

50. A furniture system as claimed in claim 49, wherein the tablet includes a cup holder to hold a cup, glass, or tumbler.

51. A furniture system as claimed in claim 50, wherein the cup holder is arranged to move between a position located in a recess in the tablet and a position located adjacent the tablet.

52. A furniture system as claimed in claim 51, wherein the cup holder is pivotally connected to the tablet.

53. A furniture system as claimed in claim 51, wherein the cup holder is slidably mounted in the tablet.

54. A furniture system as claimed in claim 51, wherein the cup holder includes a four bar linkage to provide a cup supporting base when the cup holder is positioned adjacent the tablet, and which folds up upon returning the cup holder to the recess.

55. A furniture system as claimed in claim 51, wherein the cup holder includes an elastomeric section to stabilize an item therein.

56. A furniture component as claimed in claim 1, wherein the tapered member has an eccentric shape in cross section, with the interior of the attachment portion having a cross-sectional shape which substantially corresponds to at least part of the shape of the tapered member so that rotation between the attachment portion and tapered member is inhibited when the tapers are engaged.

57. A chair comprising a base supporting a seat, a back, and a pair of tapered arm members, with a support arm of a furniture component as claimed in claim 1 attached to one of the arm members, the support arm being disengageable from the arm member by moving it upwardly and outwardly relative to the arm member.

58. A support arm for supporting a work surface from a tapered chair arm, the support arm including: an arm portion having a proximal end and a distal end; a work surface mounted substantially at the distal end; and an attachment portion defining an internal taper substantially at the proximal end, whereby the support arm is engageable on the tapered chair arm in a taper lock between the tapered chair arm and the attachment portion and disengageable manually and without the use of tools, to mount the support arm to the tapered chair arm.

59. A support arm as claimed in claim 58, wherein the work surface is in the form of a tablet.

60. A support arm as claimed in claim 59, wherein the tablet includes a cup holder to hold a cup, glass, or tumbler, and wherein the cup holder is arranged to move between a position located in a recess in the tablet and a position located adjacent the tablet.

61. A support arm as claimed in claim 58, wherein the tapered chair arm converges towards its upper end, and the internal taper in the attachment portion of the support arm converges towards its upper end, so that moving the attachment portion downwardly relative to the tapered chair arm engages the respective tapers together.

62. A chair comprising a base supporting a seat, a back, and a pair of tapered arm members, with a support arm as claimed in claim 58 attached to one of the arm members, the support arm being disengageable from the arm member by moving it upwardly and outwardly relative to the arm member.

63. A support arm as claimed in claim 58, wherein the work surface is moveable between a position in which it extends in a substantially perpendicular manner from the arm portion and a storage position in which it hangs beside the arm portion.

64. A support arm for supporting an item from a tapered member, the support arm comprising:

an arm portion having a proximal end and a distal end;

an arrangement for mounting an item substantially at the distal end; and an attachment portion substantially at the proximal end and which defines an internal taper, whereby the support arm is engageable on the tapered member in a taper lock between the tapered member and the attachment portion and disengageable manually and without the use of tools, to mount the support arm to the tapered member;

wherein the interior of the attachment portion includes one or more release shuttles, each of the one or more release shuttles being slidable relative to the attachment portion and arranged to engage the outer surface of the tapered member when the tapered member and the attachment portion are engaged.

65. A support arm for supporting an item from a tapered member, the support arm comprising:

an arm portion having a proximal end and a distal end;

an arrangement for mounting an item substantially at the distal end; and an attachment portion substantially at the proximal end and which defines an internal taper, whereby the support arm is engageable on the tapered member in a taper lock between the tapered member and the attachment portion and disengageable manually and without the use of tools, to mount the support arm to the tapered member;

wherein the attachment portion has an open part so that the interior of the attachment portion may be engaged with a tapered member having a longitudinal direction, by moving the attachment portion in a direction that is generally transverse to the longitudinal direction of the tapered member, and then sliding the attachment portion along the tapered member so that the tapers engage.

* * * * *

UNITED STATES PATENT AND TRADEMARK OFFICE

CERTIFICATE OF CORRECTION

PATENT NO. : 7,100,977 B2
APPLICATION NO. : 10/449853
DATED : September 5, 2006
INVENTOR(S) : Burwell et al.

It is certified that error appears in the above-identified patent and that said Letters Patent is hereby corrected as shown below:

Drawings

Replace FIGURE 11 with the figure depicted herein below, wherein the washer has been labeled – 134' –

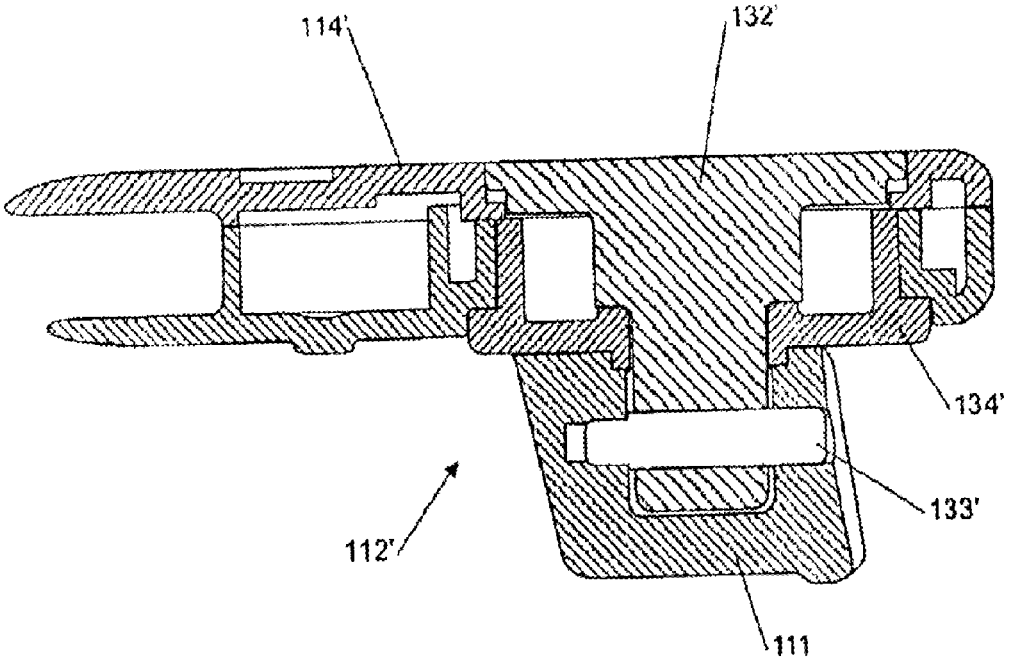

FIGURE 11

UNITED STATES PATENT AND TRADEMARK OFFICE

CERTIFICATE OF CORRECTION

PATENT NO. : 7,100,977 B2
APPLICATION NO. : 10/449853
DATED : September 5, 2006
INVENTOR(S) : Burwell et al.

It is certified that error appears in the above-identified patent and that said Letters Patent is hereby corrected as shown below:

Column 1
Line 34, after "chair", remove [,]

Column 2
Line 41, change "extends" to --extend--

Column 7
Line 58, remove [which]

Column 8
Line 6, before "each release shuttle", remove [the]

Column 9
Line 17, change "support arm" to --arm portion--
Line 29, after "30°", remove [so]

Column 16
Line 26, change "assembly" to --portion--
Line 35, change "38" to --37--

Column 17
Line 4, change "comprising" to --consisting of--

Signed and Sealed this

Twenty-fourth Day of June, 2008

JON W. DUDAS
*Director of the United States Patent and Trademark Office*